US007506499B2

(12) United States Patent
Fert et al.

(10) Patent No.: US 7,506,499 B2
(45) Date of Patent: Mar. 24, 2009

(54) TURBOFAN JET ENGINE WITH ANCILLARIES DISTRIBUTION SUPPORT

(75) Inventors: Jeremy Fert, Paris (FR); Georges Mazeaud, Yerres (FR)

(73) Assignee: Snecma, Paris (FR)

( * ) Notice: Subject to any disclaimer, the term of this patent is extended or adjusted under 35 U.S.C. 154(b) by 767 days.

(21) Appl. No.: 11/030,971

(22) Filed: Jan. 10, 2005

(65) Prior Publication Data

US 2005/0247042 A1 Nov. 10, 2005

(30) Foreign Application Priority Data

Jan. 12, 2004 (FR) ..... 04 00222

(51) Int. Cl.
*F02C 7/00* (2006.01)

(52) U.S. Cl. ..... 60/226.1; 60/796

(58) Field of Classification Search ..... 60/226.1, 60/796, 296, 802, 415, 403, 244, 262; 415/191, 415/208, 210.1, 211.2
See application file for complete search history.

(56) References Cited

U.S. PATENT DOCUMENTS 4,577,891 A * 3/1986 Fielding ..... 285/62
4,987,736 A 1/1991 Ciokajlo et al.
5,174,110 A * 12/1992 Duesler et al. ..... 60/226.1
5,292,227 A * 3/1994 Czachor et al. ..... 415/209.3
5,746,574 A 5/1998 Czachor et al.
6,041,594 A * 3/2000 Brenner et al. ..... 60/309
6,125,627 A * 10/2000 Rice et al. ..... 60/765
2002/0189233 A1 * 12/2002 Harvey et al. ..... 60/255
2003/0019205 A1 1/2003 Rice et al.
2004/0070211 A1 * 4/2004 Franchet et al. ..... 290/43

FOREIGN PATENT DOCUMENTS

EP 0 601 864 A1 6/1994

* cited by examiner

*Primary Examiner*—Michael Cuff
*Assistant Examiner*—Phutthiwat Wongwian
(74) *Attorney, Agent, or Firm*—Oblon, Spivak, McClelland, Maier & Neustadt, P.C.

(57) ABSTRACT

A turbofan jet engine includes an outer casing supported by arms, an inner casing facing the outer casing, ancillaries, and an ancillaries distribution support. The ancillaries distribution support is formed along the axis of an arm on the inner casing. The ancillaries distribution support includes a first sole plate for reception of ancillaries on the outer side of the inner casing and a second sole plate for reception of ancillaries on the inner side of the inner casing. Such a turbofan jet engine reduces the longitudinal dimension necessary for the ancillaries to pass through.

11 Claims, 6 Drawing Sheets

PRIOR ART

TURBOFAN JET ENGINE WITH ANCILLARIES DISTRIBUTION SUPPORT

TITLE OF THE INVENTION

The invention relates to a turbofan jet engine.

BACKGROUND OF THE INVENTION

I. Field of the Invention

A turbofan jet engine functionally comprises an air inlet duct, a fan, a compressor, a combustion chamber, a turbine and an exhaust nozzle. These various elements are contained in the casings.

The turbofan jet or turbojet engine also comprises an internal secondary flow casing around these casings, in the form of a ring that contains the secondary airflow on its external surface. The secondary airflow corresponds to air entrained by the fan that does not penetrate into the compressor. This ring comprises means of opening into two half-shells, so that the core of the turbojet engine can be accessed. The core of the turbojet engine means elements in the turbojet engine located within the chamber defined by the internal secondary flow casing.

Some fluids necessary for operation of the turbojet engine such as fuel and oil must be routed from the outside of the turbojet engine towards its core. These fluids are used particularly to supply the combustion chamber with fuel, the various elements of the engine with lubrication oil, various discharge valve actuation jacks, the compressor variable pitch, control of the clearance of high pressure and low pressure turbine casings, etc.

Fluids are routed through pipes commonly called ancillaries. The invention relates particularly to the passage of ancillaries along the support arm of a turbojet engine casing, called the intermediate casing.

II. Description of Related Art

FIG. 1 shows a partial view of a turbojet engine 1 according to prior art. This turbojet engine comprises the outer ring 2 of a so-called intermediate casing on the output side of the fan blade retention casing, to which the forward suspension of the turbojet engine is traditionally fixed to an aircraft. The intermediate casing also comprises radial arms 3. An inner ring 4 is arranged adjacent to its outer ring 2, this inner ring 4 comprising a bearing step 5 of the secondary flow inner casing, not shown.

Some ancillaries 6 have to be transferred from the outside of the intermediate casing to the core of the turbojet engine 1. This transfer is usually made along an arm 3 of the intermediate casing, the ancillaries 6 opening up in the core of the turbojet engine 1 at the inner ring 4.

The turbojet engine 1 presented will be installed on an aircraft with a fairly small ground clearance. Therefore, its nacelle is flattened near the bottom and spreads out on its sides. For safety reasons, the ancillaries 6 must not pass in the bottom part of the turbojet engine 1, if the turbojet engine 1 rubs along the ground. Therefore, they are routed along an arm 3 of the intermediate casing separated from the global vertical plane of symmetry of the turbojet engine 1.

The ancillaries 6 pass through the outer ring 2 of the intermediate casing and are contained between the outer ring 2 and the inner ring 4 within an arm 7, which protects them and guides the secondary airflow. The ancillaries 6 are fixed at the inner ring 4 onto a plate 8, by nuts on each side of the plate 8.

There is a fairly large number of these ancillaries 6, for example there may be eleven, and they must be guided in a fairly congested area. Furthermore, they cannot be located outside the section defined by projection on the transverse plane of the support arm 3 of the intermediate casing, in a plane transverse to the turbojet engine axis, for aerodynamic reasons related to the secondary airflow. Therefore, they have to be spread longitudinally on the plate 8. The plate 8 extends longitudinally beyond the inner ring 4 and projects into the opening area of the secondary flow internal casing cowls, particularly due to the surface area necessary for screwing the nuts, since it cannot be located in the vertical plane of symmetry containing the cowl opening hinge, as we have seen above.

Therefore, a recess has to be formed on a cowl of the inner secondary flow casing, for the plate 8 to pass through when the cowls are opened and closed. The part 8 must be adapted and must fill this recess, to assure continuity of the airflow guidance between the inner ring 4 and the surface of the inner secondary flow casing, at the recess. Production costs of the said casing and maintenance cost of the turbojet engine are correspondingly increased.

BRIEF SUMMARY OF THE INVENTION

This invention is designed to reduce production costs of the inner secondary flow casing, to simplify turbojet engine maintenance and to facilitate access to the turbojet engine core at the ancillaries along the arm of the intermediate casing.

According to the invention, a double flow turbojet engine comprising an outer casing supported by arms, an inner casing facing the outer casing and ancillaries is characterised by the fact that an ancillaries reception support is formed along the axis of an arm, on the inner casing, comprising a first sole plate for reception of ancillaries on the outer side of the inner casing.

For the purposes of this description, axis means the centreline or the direction of the gas flow around the arm.

Thus, due to the ancillaries distribution support according to the invention, there is no longer any need to make a cut out in the inner secondary flow casing of the turbojet engine since the longitudinal dimension is reduced.

Preferably, the first sole plate comprises ancillary reception ducts.

Advantageously, the ancillaries distribution support comprises a second sole plate for the distribution of ancillaries on the internal side of the inner casing.

Advantageously in this case, the ancillaries reception ducts open up onto the second sole plate which comprises ancillary fittings.

In the preferred embodiment of the invention, the outer casing comprises an ancillaries passage assembly.

Preferably, the ancillaries passage assembly comprises an attachment flange supporting a seal, and a seal support.

Also preferably, the seal is made of an elastomer material and comprises ancillary passage ducts.

Advantageously, the turbojet engine comprises an ancillaries protection arm mounted between the ancillaries passage assembly and the ancillaries distribution support.

The invention is particularly applicable to an outer casing that is the outer ring of the intermediate casing of a turbojet engine, and an inner casing that is the inner ring of the intermediate casing, but the applicant does not intend to limit the scope of his rights to this application.

The invention also relates to an ancillaries distribution support for the turbojet engine mentioned above as an intermediate product, comprising a first sole plate for reception of the ancillaries and a second sole plate for the distribution of ancillaries.

Preferably, the ancillaries reception sole plate comprises ancillary reception ducts.

Also preferably, metallic locking plates fixing the ancillaries in translation are arranged on the ancillary reception sole plate.

Advantageously, the ducts open up on the distribution sole plate, that comprises ancillary fittings at the ends of the ducts.

BRIEF DESCRIPTION OF THE DRAWINGS

The invention will be better understood after reading the following description of the preferred embodiment of the turbojet engine and the ancillaries distribution support according to the invention, with reference to the attached drawing on which.

DETAILED DESCRIPTION OF THE INVENTION

Figure 1:
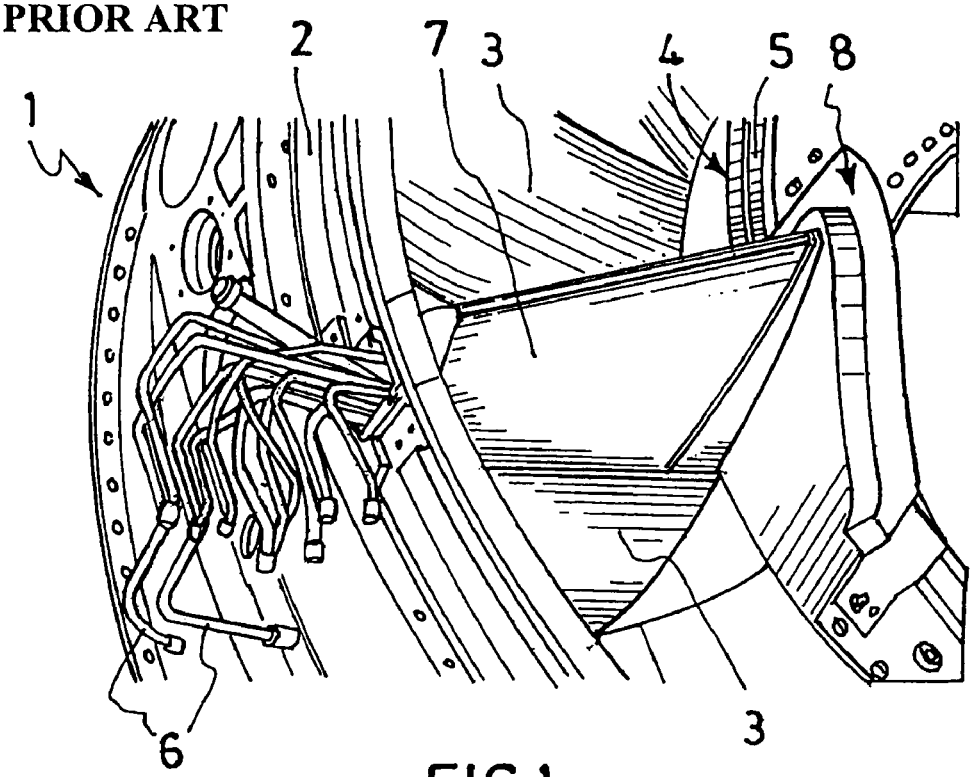
FIG. 1 shows the partial diagrammatic perspective view of a turbojet engine according to prior art.
Figure 2:
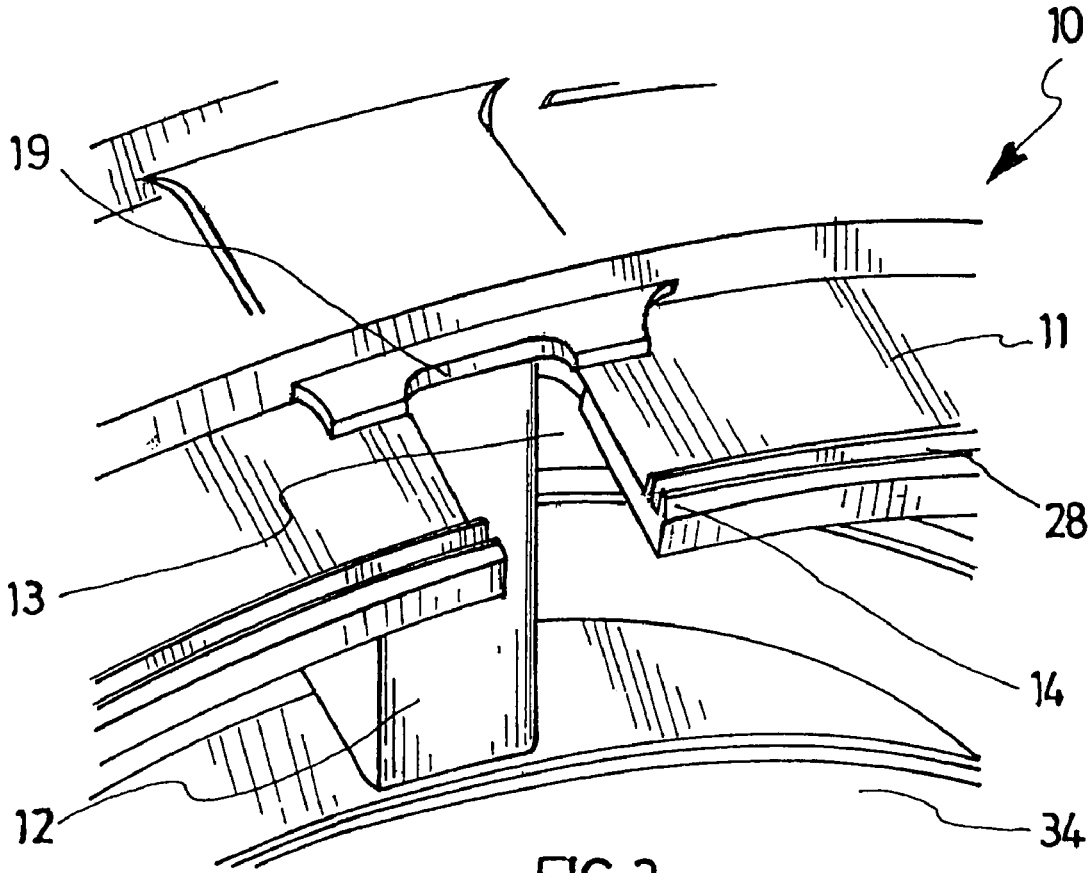
FIG. 2 shows a partial diagrammatic perspective view of the intermediate casing, in a preferred embodiment of the turbojet engine according to the invention.

With reference to FIG. 2, the turbojet engine 10 according to the invention comprises a casing called the intermediate casing, on the output side of the fan blades retention casing, through which the forward suspension of the turbojet engine 10 is traditionally fixed to an aircraft; the intermediate casing comprises an outer ring 11 supported by radial arms 12, at the bottom of which an inner ring 34 extends on the output side, facing the outer ring 11.

The invention is particularly applicable to routing of ancillaries along a radial arm 12 of the intermediate casing.

To facilitate differentiation between the elements, we will denote the outer ring 11 of the intermediate casing simply by the term "intermediate casing 11", and the internal ring 34 of the intermediate casing simply by the term "ring 34", in the following description.

A globally rectangular recess 13 is formed on the intermediate casing 11 facing the ring 34, from the output edge 14 of the intermediate casing 11. The intermediate casing 11 comprises a gutter 28 along the circumference of its output edge 14.

Figure 3:
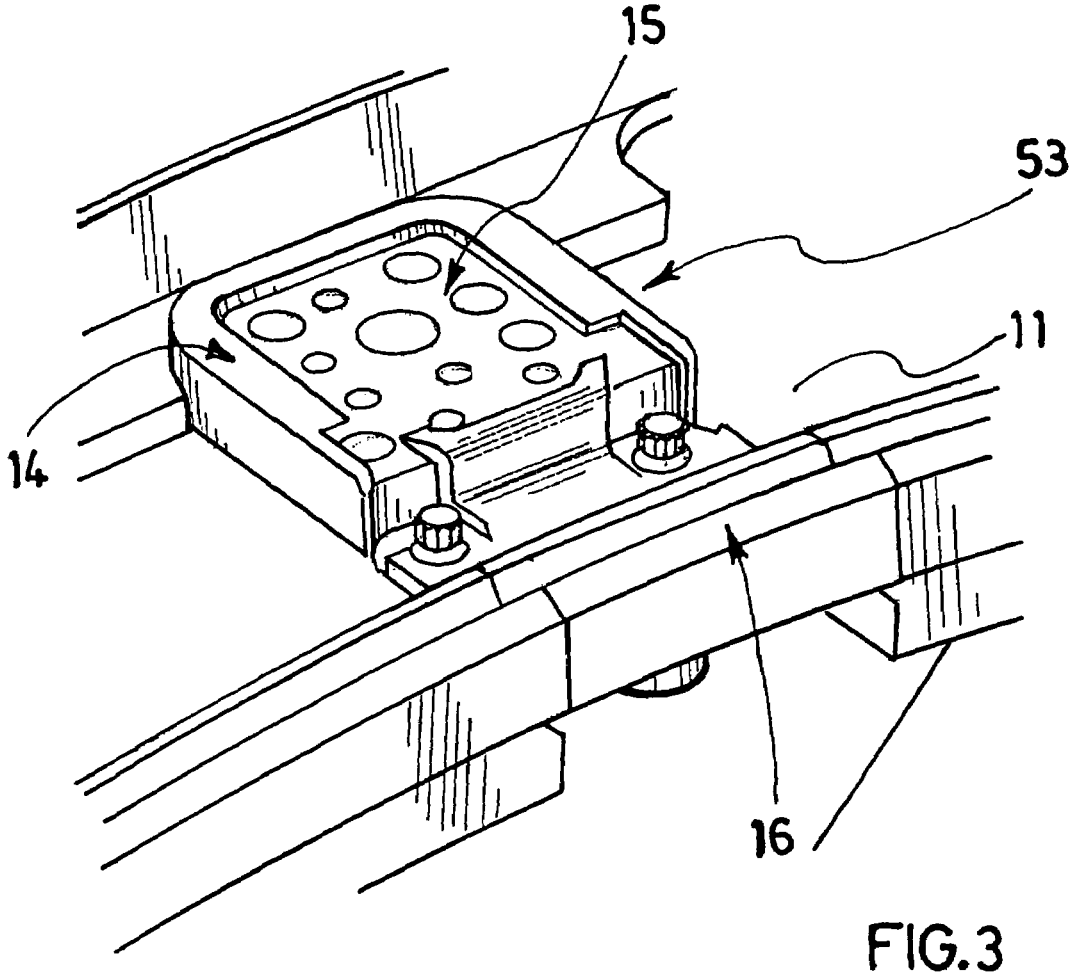
FIG. 3 shows a partial diagrammatic perspective view of the outer ring of the intermediate casing with its flange, its elastomer seal and its seal support, in the preferred embodiment of the turbojet engine according to the invention.

With reference to FIG. 3, the recess 13 is arranged to hold an ancillaries passage assembly 53 comprising an attachment flange 14 supporting an ancillaries guide and flange seal 15, and a part 16 that will be called the seal support 16.

The various parts of the turbojet engine according to the invention will be described in the turbojet engine coordinate system in the remainder of this description. Thus, when a figure shows parts not installed on the turbojet engine, their various portions will be denoted as a function of their placement when they are installed. The various qualifications such as inner, outer, radial, axial, longitudinal, upstream, output, should be considered within the turbojet engine coordinate system, particularly as a function of its centreline.

Figure 4:
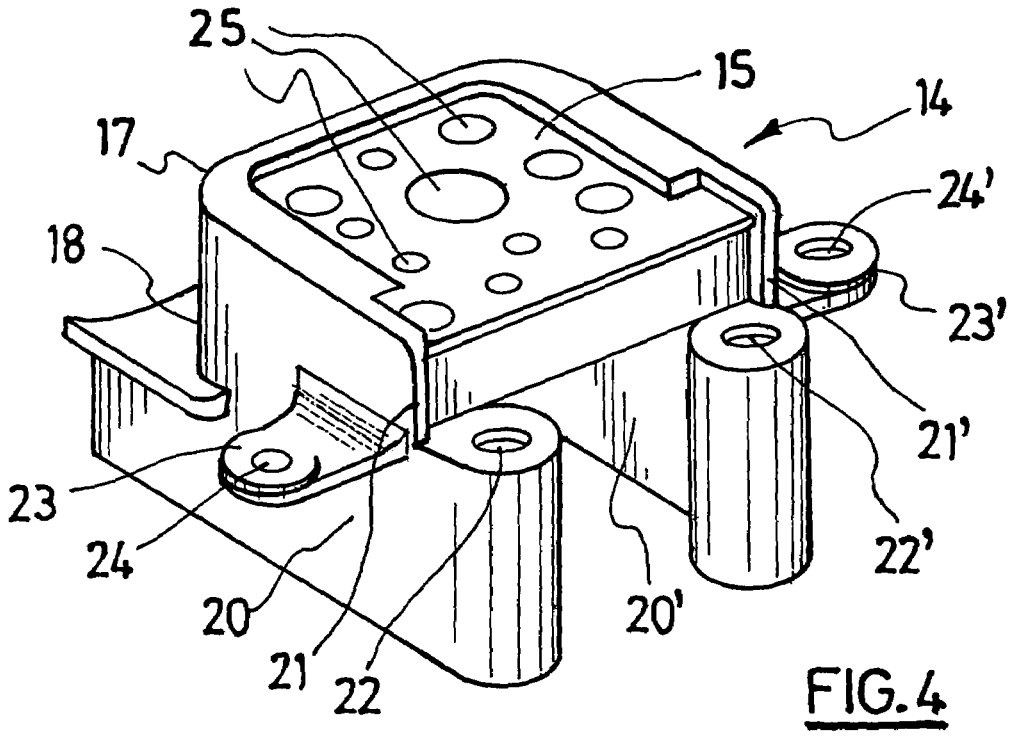
FIG. 4 shows a diagrammatic perspective view of the flange and the elastomer seal of the preferred embodiment of the turbojet engine according to the invention.

With reference to FIG. 4, the flange 14 is globally in the form of a metallic yoke, comprising a base 17 and two branches 20, 20' slightly curved to adapt to the form of the intermediate casing 11. The base 17 of the flange 14 is arranged to bear on the upstream bottom 19 of the recess 13 of the intermediate casing 11. It comprises a longitudinal step 18, for which the projecting part is on the internal side of the base 17. The step 18 is shaped to bear in contact on the inner face of the intermediate casing 11 on the upstream side of the recess 13.

A seal 15, in this case made of an elastomer material, is installed between the branches 20, 20' of its outer side of the flange 14, the outer surface of the seal being at the same level as the outer surface of the flange 14. Several radial ancillary passage ducts 25 pass through the elastomer seal 15. At its output end, the flange 14 comprises a longitudinal step 21, 21' at each of its branches 20, 20', located at a shorter distance from the outer surface of the flange than the distance from the opposite step 18.

Two radial drillings 22, 22' are made on the steps 21, 21' facing the branches 20, for reception of a screw. Two lugs 23, 23' project on the lateral faces of the branches 20, 20', on the upstream side of the steps 21, 21'. A radial drilling 24, 24' is made in each lug.

Figure 5:
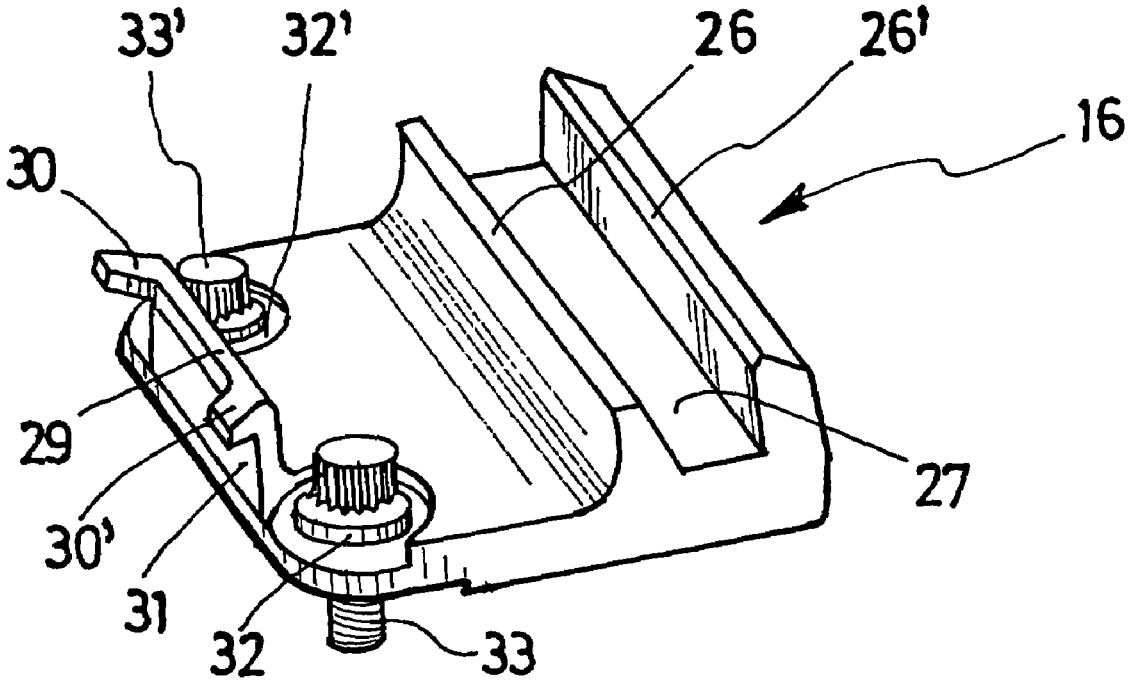
FIG. 5 shows a diagrammatic perspective view of the seal support in the preferred embodiment of the turbojet engine according to the invention.

With reference to FIG. 5, the seal support 16 is in the form of a metallic plate. On its output edge, it comprises two radial protrusions 26, 26' forming a gutter 27, arranged to achieve continuity of the gutter 28 of the intermediate casing 11.

On its upstream edge, the seal support 16 comprises a central radial protrusion 29 comprising two longitudinal dogs 30, 30' extending towards the upstream side, at its outer end. The upstream face 31 of the protrusion 29 and its dogs 30, 30' are shaped to come into contact on the output face and the outer face of the elastomer seal 15, respectively.

The seal support 16 also comprises two radial drillings 32, 32' for reception of screws 33, 33' on its upstream edge on each side of the central protrusion 29, the radial drillings being separated from each other by the same distance as the drillings 22, 22' in the flange 14.

The assembly of the flange 14 on which the elastomer seal 15 and the seal support 16 is arranged in the recess 13, is as follows. The flange 14 is installed in the recess 13 with its base 17 bearing in contact on the upstream bottom 19 of the recess 13 and its step 18 bearing in contact with the inner face of the intermediate casing 11 on the upstream side of the recess 13. The lugs 23, 23' are in contact with the inner face of the intermediate casing 11, and are fixed to it by screws in their drillings 24, 24'. The seal support 16 is fixed to the flange 14 by screws 33, 33' in the drillings 22, 22' of the flange 14 through the drillings 32, 32' in the seal support 16. The upstream face 31 of the protrusion 29 and its dogs 30, 30' then bear on the output face and the outer face of the elastomer seal 15 and there is continuity between the two. Furthermore in this configuration, the gutter 27 of the seal support 16 makes the gutter 28 of the intermediate casing 11 continuous.

Thus mounted, the flange 14, the elastomer seal 15 and the seal support 16 assure continuity of the intermediate casing 11 while providing ancillaries passage ducts 25. They form an ancillaries passage assembly 53 through which ancillaries pass through the intermediate casing 11, while keeping them clamped in contact with each other, depending to the distribution of ducts 25 on the elastomer seal 15. It also makes the assembly seal, the ancillaries being force fitted into their ducts 25.

Figure 6:
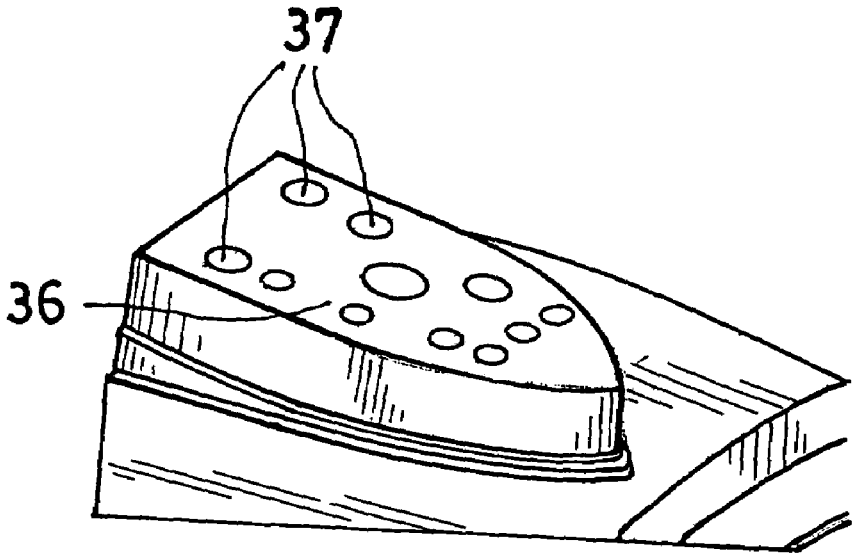
FIG. 6 shows a perspective diagrammatic view of the sole plate of the ancillaries support in the preferred embodiment of the ancillaries distribution support according to the invention.
Figure 7:
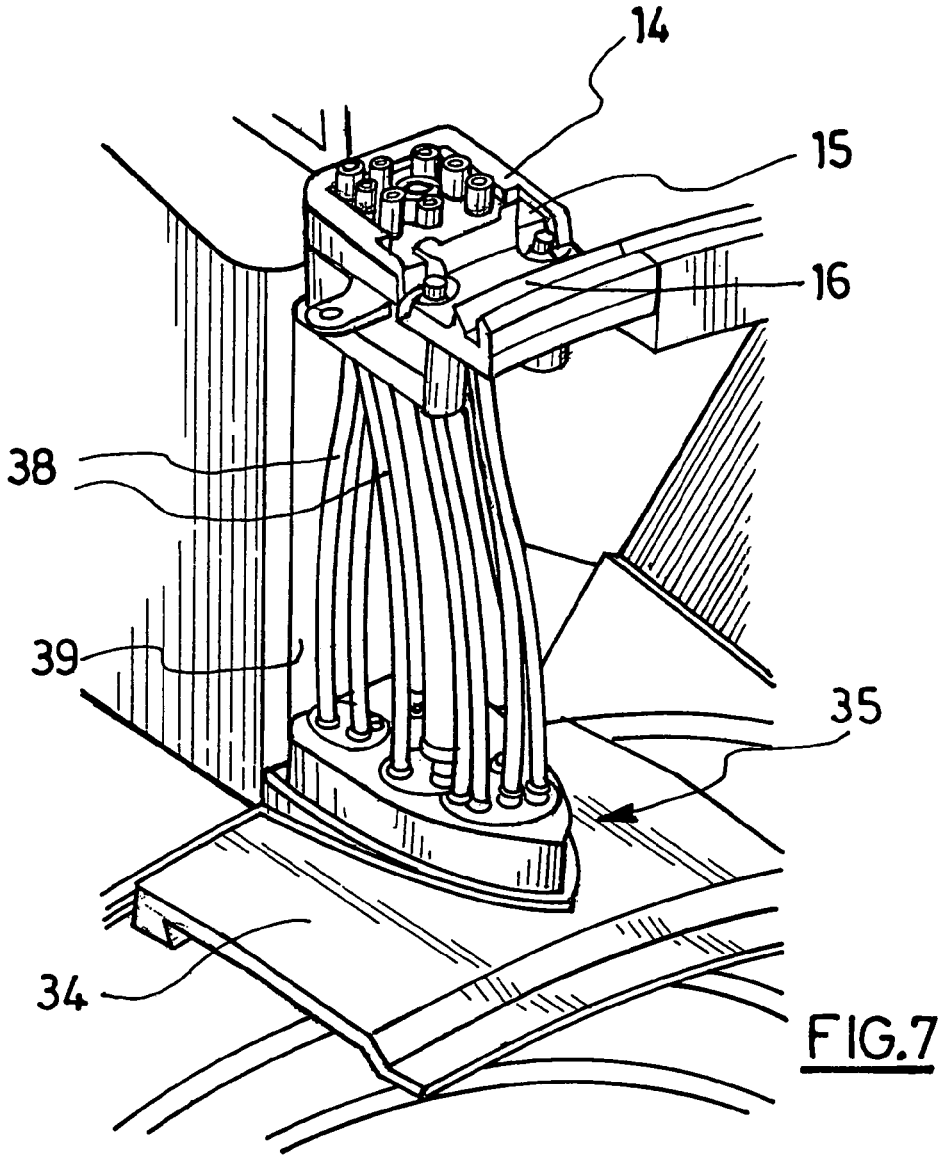
FIG. 7 shows a partial diagrammatic perspective view of the preferred embodiment of the turbojet engine according to the invention, without its ancillaries protection arm.

With reference to FIGS. 6 and 7, an ancillaries distribution support 35 is arranged on the ring 34 of the turbojet engine 10, placed adjacent to the ancillaries passage assembly 53.

The support 35 comprises a first sole plate on the outer side of the ring 34 for reception of ancillaries 38 projecting outside the ring. The sole plate 36 has a rounded triangular shape, the base of which is located on the upstream side of the ring 34 at the arm 12, and the vertex is on the output side of the ring 34. The width of the base corresponds approximately to the transverse width of the arm 12. The first sole plate 36 comprises ancillary reception duct 37, opening up on its outer surface.

Ancillaries 38, originating from outside the intermediate casing 11, are inserted in the ducts 25 of the elastomer seal 15, extending along a radial support 39 parallel to the arm 12 installed between the intermediate casing 11 and the ring 34, and their ends are force fitted into the ducts 37 of the sole plate 36.

Figure 8:
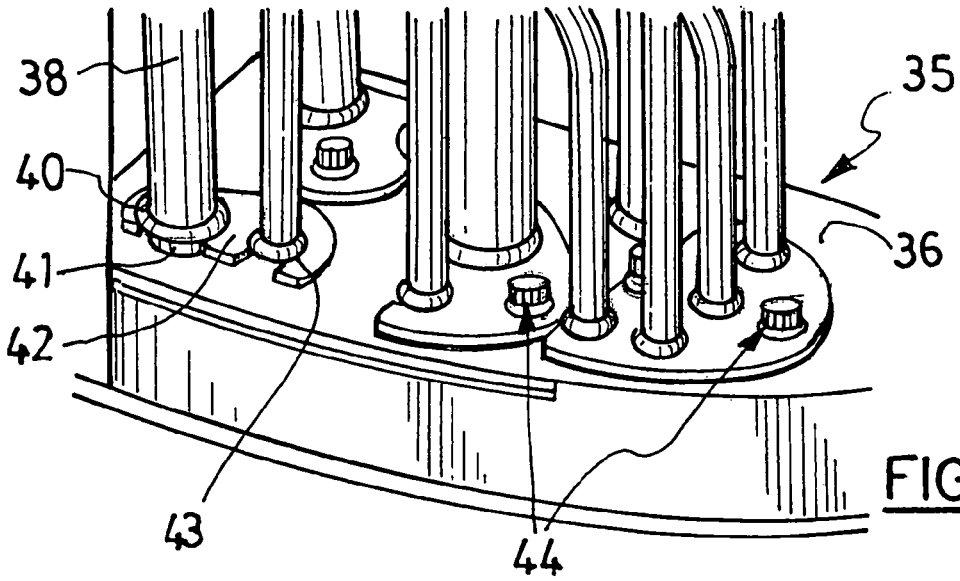
FIG. 8 shows a partial diagrammatic perspective view of the preferred embodiment of the ancillaries distribution support according to the invention.

With reference to FIG. 8, the end of the ancillaries 38 comprises a special end piece composed of an annular seal 40 comprising an annular groove 41. The seal 40 is adapted to its reception duct 37 and its force fitted such that its groove 41 is flush with the surface of the first sole plate 36. Metallic plates 42 comprising adapted recesses 43 are fixed using screws 44 onto the sole plate 36, their recesses 43 being on the grooves 41 of the seals 40 of the ancillaries 38 in order to block them in radial translation.

Figure 9:
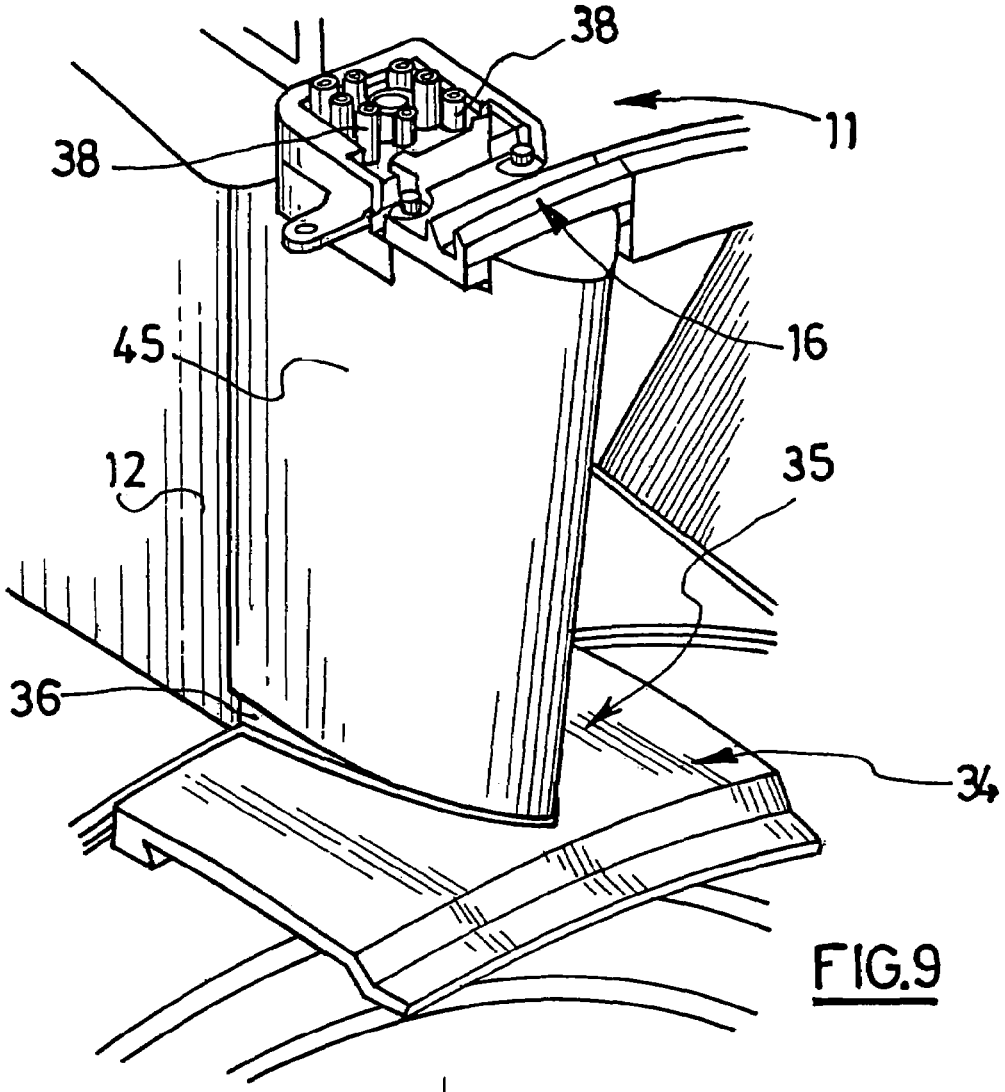
FIG. 9 shows a partial diagrammatic perspective view of the preferred embodiment of the turbojet engine according to the invention, with its ancillaries protection arm.

With reference to FIG. 9, an ancillaries protection arm 45 is fixed to the sole plate 36, to the radial support 39, to the flange 14 and to the seal support 16. This arm 45 is in the form of a plate adapted to all elements to which it is fixed, to protect the assembly. Its section is globally constant and corresponds to the contour of the sole plate 36. It is arranged to complete the shape of the arm in order to guide the secondary airflow passing between the intermediate casing 11 and the ring 34. This shape is adapted to dynamic constraints imposed on the flow, and depends on parameters related mainly to fluid mechanics.

Figure 10:
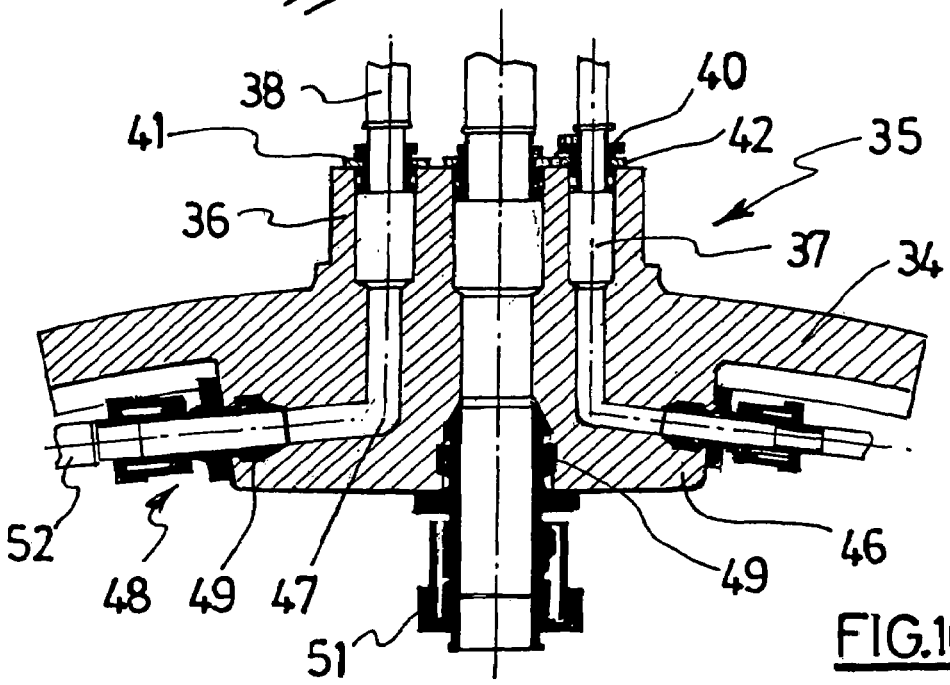
FIG. 10 shows a sectional diagrammatic view of the preferred embodiment of the ancillaries distribution support according to the invention.
Figure 11:
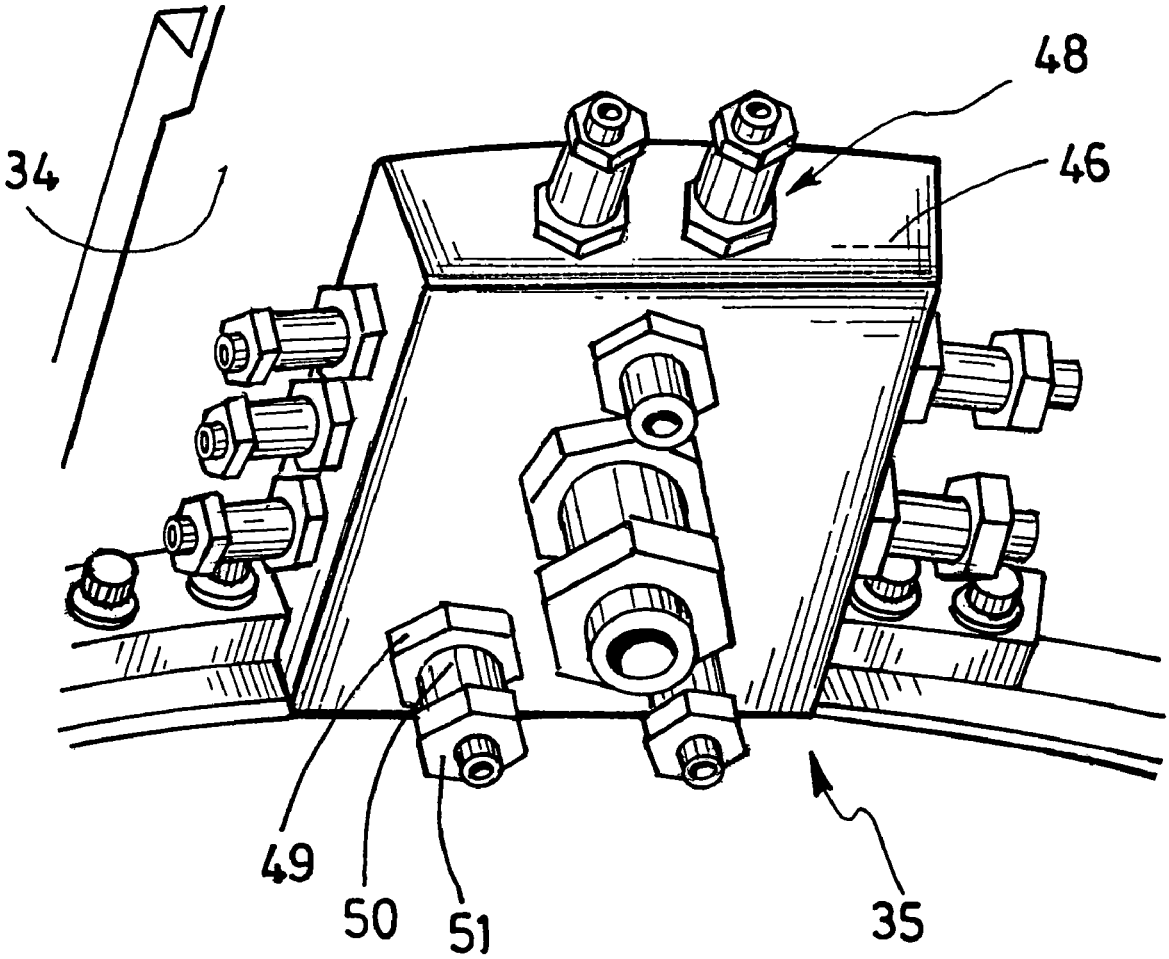
FIG. 11 shows a diagrammatic bottom view of the preferred embodiment of the ancillaries distribution support according to the invention.

With reference to FIGS. 10 and 11, the ancillaries distribution support 35 comprises a second sole plate 46 on the inner side of the ring, located facing the first sole plate 36. The reception ducts 37 of the ancillaries 38 pass through the first external sole plate 36 and prolong in the second distribution sole plate 46. They may be oriented in the second distribution sole plate by an elbow 47, so as to open up onto a lateral face of the second sole plate 46, or they may not change direction and open up onto the inner face of the second sole plate 46. They may also change diameter if required.

Ancillaries fittings 48 are arranged on the open end of the ducts 37, on the second sole plate 46. These fittings 48 comprise a fitting seal 49, a nozzle 50 and an ancyllary screw-in nut 51. Thus, ancillaries 52 fitted with specially arranged end pieces can be used to connect the ancillary fittings 48 to the second sole plate 46.

The invention provides a solution to the crossing of the ancillaries 38 passing between the intermediate casing 11 and the ring 34. The ancillaries 38 are inserted in the ducts 25 of the elastomer seal 15, extending in the chamber formed by the arm 45 and the radial support 39 between the intermediate casing 11 and the ring 34, and are inserted in the ducts 37 of the ancillaries distribution support 35, through their end pieces 40 adapted to this purpose, at which they are blocked in radial translation by metallic plates 42. The ducts 37 make the link with the ancillaries 52 inside the ring 34, in other words the core of the turbojet engine 10, that are connected to them by the fittings 48 of the distribution sole plate 46.

The ducts 25 of the elastomer seal 15, the ducts 37 of the ancillaries distribution support 35, the metallic plates 42 and the fittings 48 of the second sole plate 46 are sized and shaped as a function of the ancillaries 38, 52 that they have to connect. Therefore, the invention provides a solution in which the ancillaries are assembled very simply in a standard manner.

Furthermore, particularly due to the fact that the ancillaries 38, 52 are no longer fixed by nuts on each side of the ring 34 and instead are force fitted into the ducts 37 or end pieces 48, a large amount of space is saved for their connection, resulting in an ancillaries distribution support 35 in which the longitudinal surface does not extend beyond the surface of the ring 34. Therefore, there is no longer any need to form a recess in the cowls of the internal secondary flow casing, since the arm 45 adjacent to the ancillaries distribution support 35, and particularly its first sole plate 36, does not occupy any of the opening and closing areas.

The ancillaries distribution support 35 may indifferently be formed from a single piece with the ring 34 or it may be added onto the ring.

The invention claimed is:

1. A turbofan jet engine, comprising:

an outer casing supported by arms and including a recess therein;

an ancillaries passage assembly positioned in the recess of the outer casing;

an inner casing facing the outer casing;

ancillaries that pass through the ancillaries passage assembly; and an ancillaries distribution support formed along an axis of one of the arms and positioned on the inner casing, comprising:

a first sole plate including a first set of ancillaries reception ducts to receive the ancillaries therein, wherein the first sole plate is positioned on an outer side of the inner casing, and a second sole plate including a second set of ancillaries reception ducts to receive the ancillaries therein, wherein the second sole plate is positioned on an inner side of the inner casing.

2. The turbofan jet engine according to claim 1, wherein the second set of ancillaries reception ducts include ancillaries fittings.

3. The turbofan jet engine according to claim 1, wherein the ancillaries passage assembly comprises an attachment flange, supporting a seal, and a seal support, the seal is positioned in the recess of the of the outer casing and surrounded on three sides by the attachment flange, wherein the attachment flange does not surround a fourth side of the seal, and the seal support is attached to the attachment flange such that the seal support surrounds the seal on the fourth side to fix the seal within the attachment.

4. The turbofan jet according to claim 3, wherein the seal comprises ancillaries passage ducts that receive the ancillaries therein.

5. The turbofan jet engine according to claim 4, wherein the seal is made of an elastomer material.

6. The turbofan jet engine according to claim 1, further comprising:

an ancillaries protection arm installed between the ancillaries passage assembly and the ancillaries distribution support.

7. The turbofan jet engine according to claim 1, wherein the outer casing is an outer ring of an intermediate casing and the inner casing is an inner ring of the intermediate casing.

8. The turbofan jet engine according to claim 1, wherein the ancillaries are fixed to the first set of ancillaries reception ducts without using nuts.

9. The turbofan jet according to claim 3, wherein the outer casing includes a first gutter along a circumference of an output edge of the outer casing, and the seal support is positioned in the recess of the outer casing and includes a second gutter that is continuous with the first gutter.

10. The turbofan jet engine according to claim 1, wherein the first sole plate has a rounded triangular shape.

11. The turbofan jet engine according to claim 1, wherein each of the ancillaries includes a seal having an annular groove on a first end of the ancillaries, the first sole plate includes a plurality of metallic plates including recesses, and the annular groove of the seal of each of the ancillaries fits within one of the recesses of the metallic plates to block each of the ancillaries in translation.

* * * * *

UNITED STATES PATENT AND TRADEMARK OFFICE

CERTIFICATE OF CORRECTION

PATENT NO. : 7,506,499 B2
APPLICATION NO. : 11/030971
DATED : March 24, 2009
INVENTOR(S) : Jeremy Fert et al.

It is certified that error appears in the above-identified patent and that said Letters Patent is hereby corrected as shown below:

In column 6, Claim 3, line 64, please change:

"of the of the" to -- of the--.

Signed and Sealed this

Twenty-eighth Day of July, 2009

JOHN DOLL
*Acting Director of the United States Patent and Trademark Office*